United States Patent [19]

Cox

[11] 4,233,000

[45] Nov. 11, 1980

[54] VARIABLE RATIO INTENSIFIER

[75] Inventor: Bruce M. Cox, Duncan, Okla.

[73] Assignee: Halliburton Company, Duncan, Okla.

[21] Appl. No.: 99,449

[22] Filed: Dec. 3, 1979

Related U.S. Application Data

[63] Continuation of Ser. No. 896,664, Apr. 17, 1978, abandoned.

[51] Int. Cl.[3] ..... F04B 21/04

[52] U.S. Cl. ..... 417/402; 403/287; 92/60.5; 92/171

[58] Field of Search ..... F16D/1/00; 417/238, 417/402, 403, 437, 401; 92/171, 60.5, 129, 255, 258; 403/287, 378, 379

[56] References Cited

U.S. PATENT DOCUMENTS

| | | | |
|---|---|---|---|
| 1,654,673 | 1/1928 | Barks | 417/402 |
| 2,447,340 | 8/1948 | Jackson | 92/171 X |
| 2,479,807 | 8/1949 | Bertea | 403/379 |
| 2,945,444 | 7/1960 | Leissner | 417/454 X |
| 3,046,070 | 7/1962 | Gearhart | 92/258 X |
| 3,049,082 | 8/1962 | Barry | 92/171 X |
| 3,156,320 | 11/1964 | Bystricky et al. | 417/401 X |
| 3,737,254 | 6/1973 | Swatty | 417/403 |
| 4,080,877 | 3/1978 | de Fries | 92/169 X |
| 4,125,176 | 11/1978 | Thrasher, Jr. | 417/238 |

FOREIGN PATENT DOCUMENTS

| | | | |
|---|---|---|---|
| 1139148 | 6/1957 | France | 417/401 |
| 1288221 | 2/1962 | France | 417/401 |

*Primary Examiner*—Leonard E. Smith

*Attorney, Agent, or Firm*—James R. Duzan; John H. Tregoning

[57] ABSTRACT

An improved differential pressure hydraulic pressure convertor whose ratio of output pressure to input pressure may be easily varied comprising a valve housing, a pump housing having a cylindrical bore therethrough, a power cylinder including a differential piston located between the valve housing and the pump housing, a piston assembly detachably secured to the differential piston of the power assembly and, optionally, a sleeve installed in the cylindrical bore in the pump housing slidably receiving the piston of the piston assembly.

4 Claims, 7 Drawing Figures

VARIABLE RATIO INTENSIFIER

This is a continuation of application Ser. No. 896,664 filed Apr. 17, 1978, now abandoned.

The present invention relates to an improved differential pressure hydraulic power convertor. More specifically, the present invention relates to an improved differential pressure hydraulic power convertor having interchangeable piston assemblies and sleeves to easily vary the ratio of the output fluid pressure to the input fluid pressure of the convertor.

The prior art discloses hydraulic pressure convertors employing differential pistons which, on the power stroke, operate a pump which delivers fluid under pressure at a higher pressure than the line pressure supplied from a pressurized source. In these prior art devices, valve means connect the power cylinder at both sides continuously to the fluid pressure source and alternately connect the cylinder at opposite sides of the piston to each other. Such prior art devices are exemplified in U.S. Pat. Nos. 2,749,886 and 3,589,839. Typically, in these devices, the piston is driven on its power stroke by the differential in total pressure on its opposite sides and is driven on its return stroke by full line pressure applied to one side while the other side is vented to exhaust pressure.

However, these prior art devices do not use the potential of the line pressure to the best advantage, do not operate to effect as rapid a return as desirable of the differential piston after completion of its power stroke, do not provide a regenerative circuit for the transfer of fluid pressure from the power side of the differential piston to the opposite side of the piston during the return stroke, and cannot be easily converted from one ratio to another desired ratio of output fluid pressure to the input fluid pressure.

Another type prior art differential pressure hydraulic power convertor eliminates many of the undesirable features in the prior art devices discussed above by operating under full line pressure on its power stroke by fluid being applied to its cylinder at one side of the differential piston while the cylinder at the opposite side of the piston is vented to atmospheric pressure. In this prior art device, the system is regenerative on the return stroke, and the shift from advance to return of the piston is substantially instantaneous due to a specialized control valve. Such a prior art device is discussed in U.S. Pat. No. 3,737,254.

However, although the prior art device disclosed in U.S. Pat. No. 3,737,254 eliminates many of the problems of previous prior art devices, the convertor cannot be easily converted from one ratio to another desired ratio of output fluid pressure to input fluid pressure.

In contrast to the prior devices, the present invention comprises an improved differential pressure hydraulic power convertor which utilizes full line pressure on its power stroke by fluid being applied to its cylinder at one side of the differential piston while the cylinder at the opposite side of the piston is vented to atmospheric pressure, which is regenerative on the return stroke of the piston, which shifts from advance to return of the piston substantially instantaneously, and which can be easily converted from one ratio to another desired ratio of output fluid pressure to input fluid pressure. The present invention comprises a differential pressure hydraulic power convertor constructed such that interchangeable piston assemblies and sleeves can be used to easily vary the ratio of the output fluid pressure to the input fluid pressure of the convertor.

The foregoing advantages and the preferred embodiments of the invention will be better understood from the following specification taken in conjunction with the accompanying drawings wherein.

Figure 1:
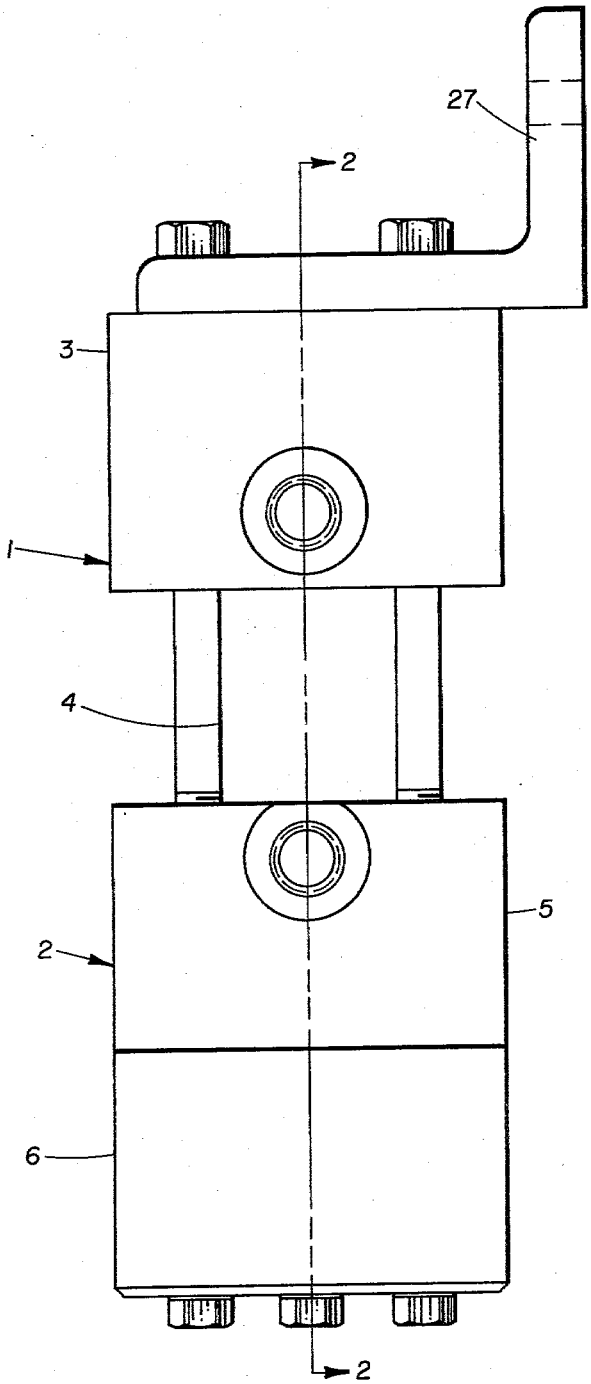
FIG. 1 PRIOR ART
FIG. 1 is a view of a prior art differential pressure hydraulic power convertor.
Figure 2:
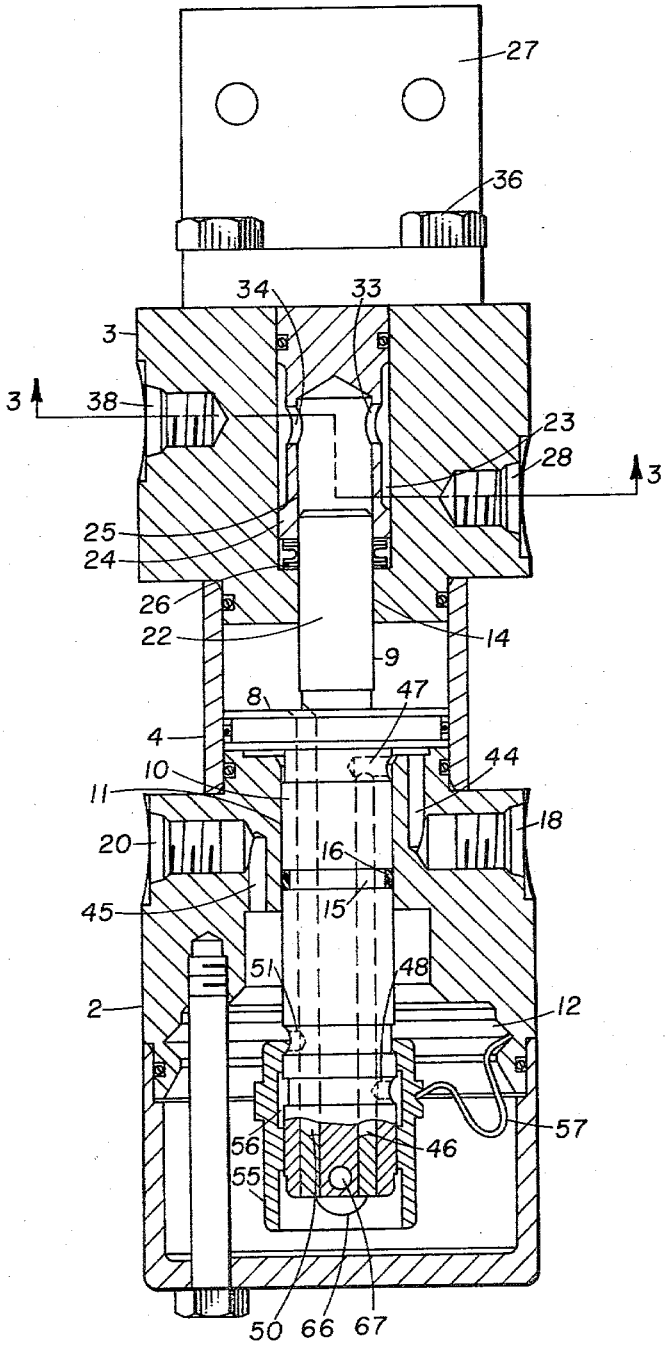
FIG. 2 PRIOR ART
FIG. 2 is a cross-sectional view along line 2—2 of the prior art differential pressure hydraulic power convertor shown in FIG. 1.
Figure 2A:
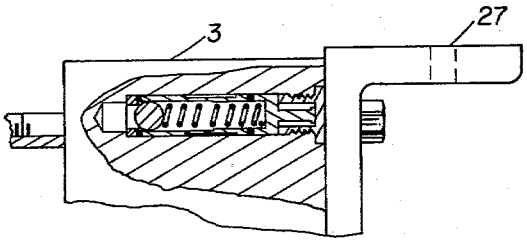
FIG. 2a PRIOR ART

FIG. 2*a* is a view of a check valve arrangement for controlling fluid flow in the inlet and outlet of the differential pressure hydraulic convertor as shown in FIGS. 1 and 2.

Figure 3:
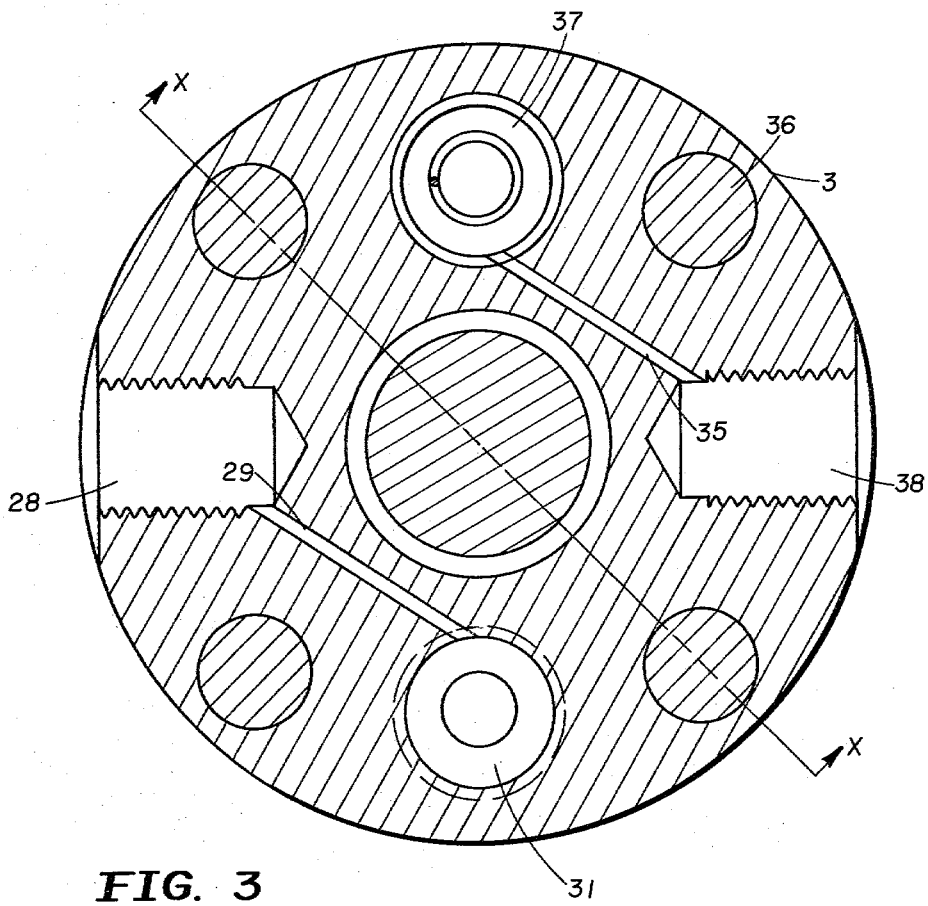
FIG. 3 PRIOR ART

FIG. 3 is a cross-sectional view along line 3—3 of the prior art differential pressure hydraulic power convertor shown in FIG. 2.

Figure 4:
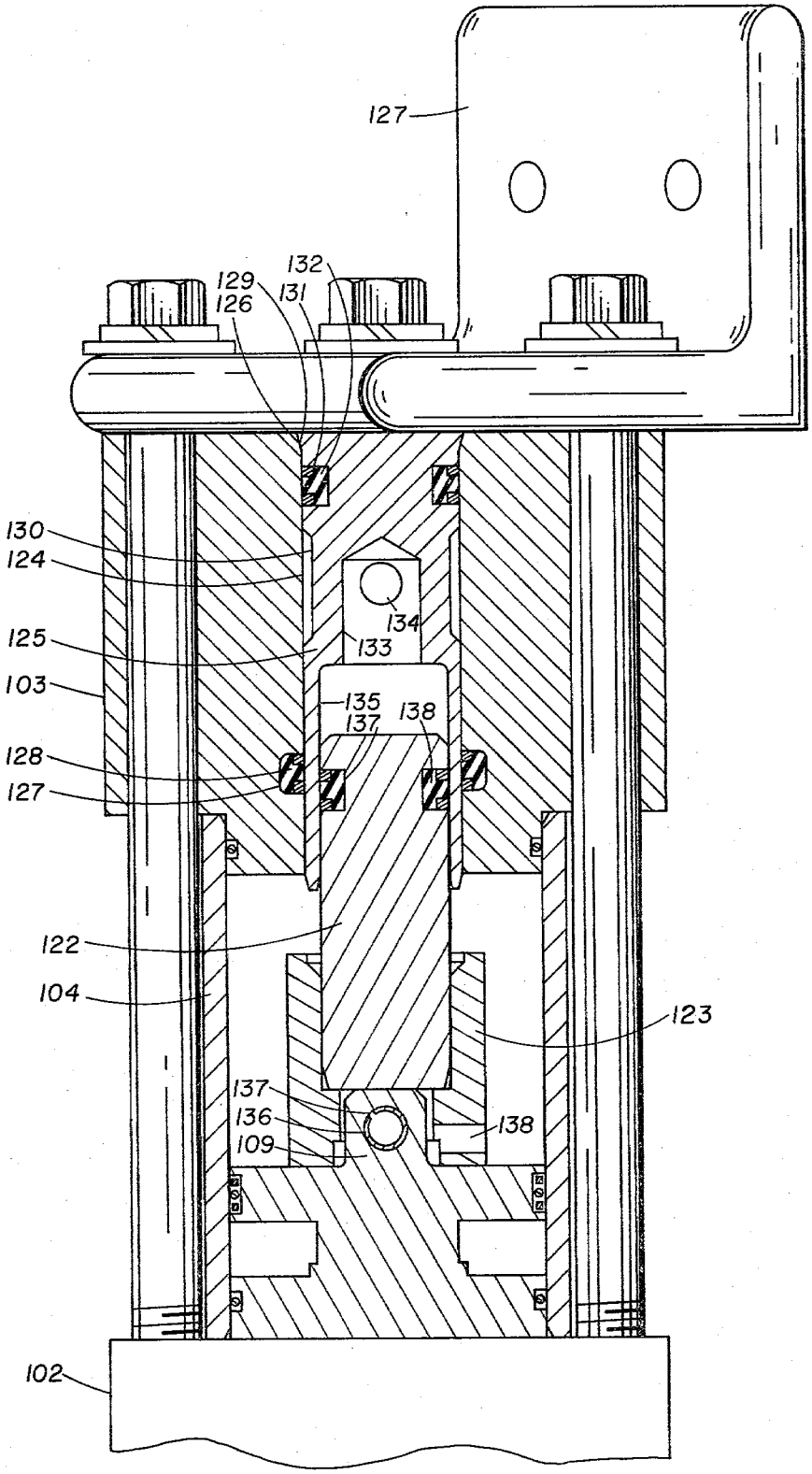

FIG. 4 is a cross-sectional view along line x—x of FIG. 3 of a first embodiment of the present invention with the mounting bracket and fasteners shown in full view.

Figure 5:
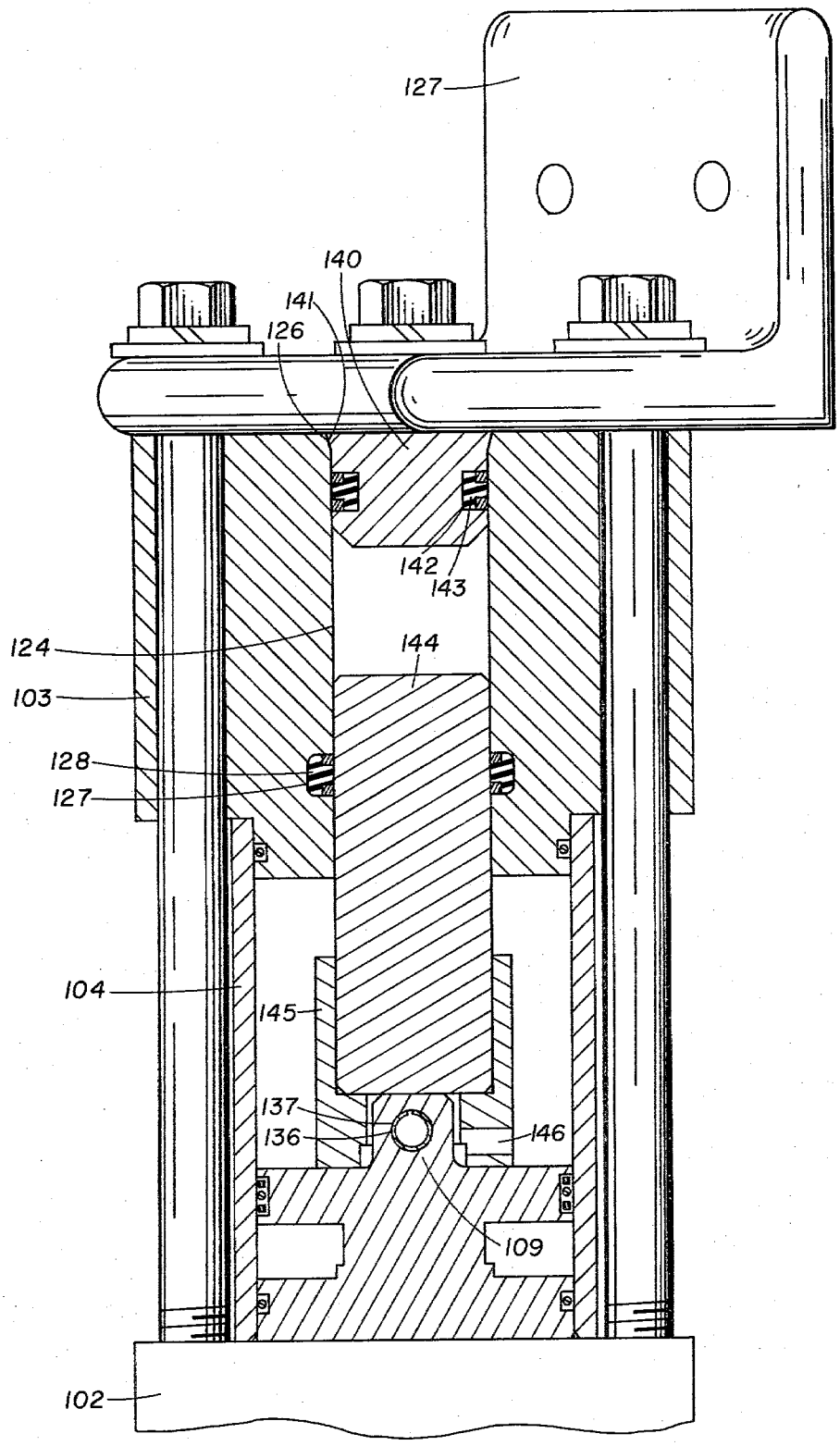

FIG. 5 is a cross-sectional view along line x—x of FIG. 3 of a second embodiment of the present invention with the mounting bracket and fasteners shown in full view.

Figure 6:
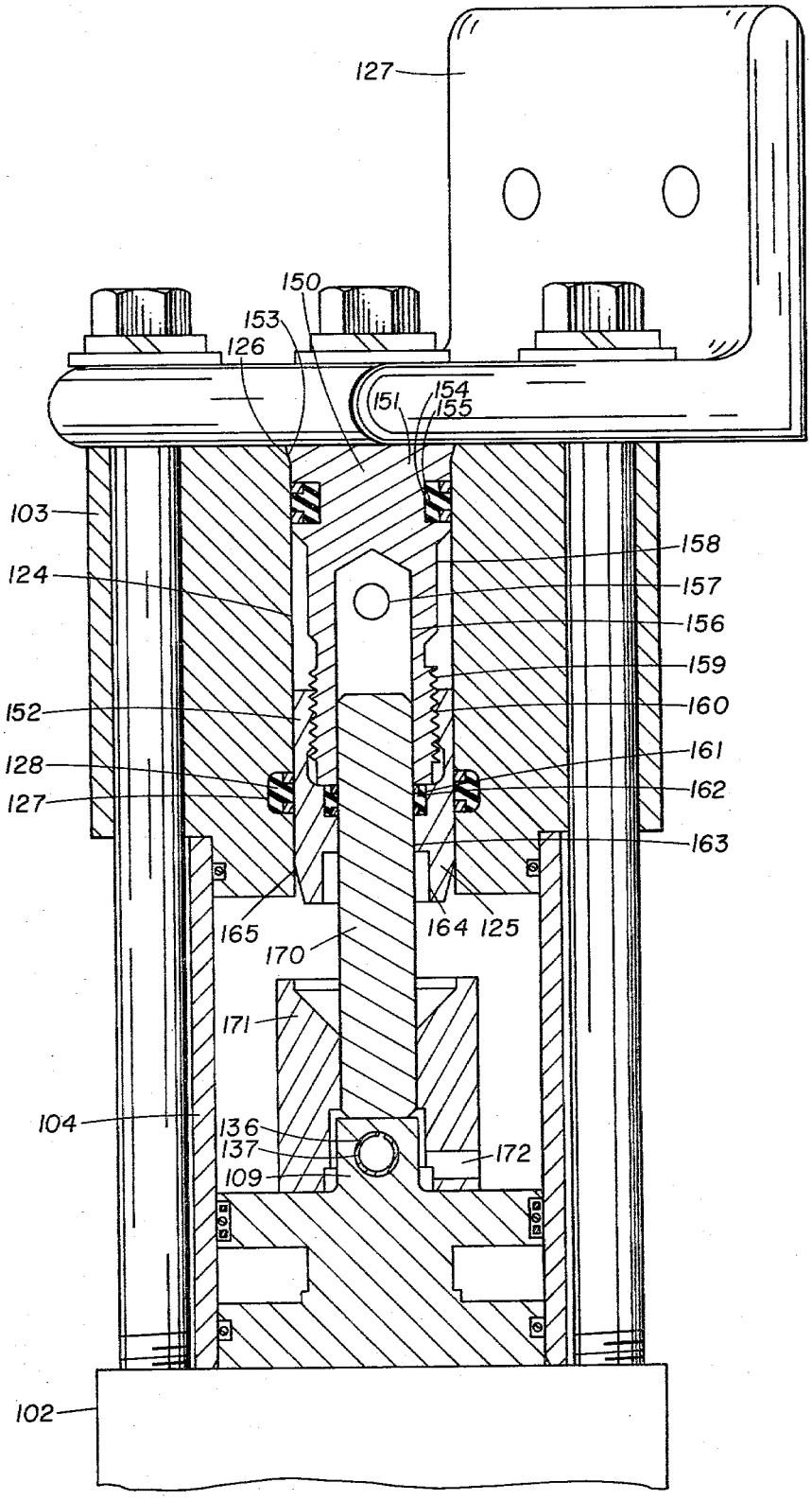

FIG. 6 is a cross-sectional view along line x—x of FIG. 3 of a third embodiment of the present invention with the mounting bracket and fasteners shown in full view.

Referring to FIG. 1 of the drawings, a typical prior art differential pressure hydraulic convertor is shown. The convertor comprises a body 1 composed of a valve housing 2, a pump housing 3, and a power cylinder 4 therebetween and communicating therewith. The valve housing 2 may be formed of a main body portion 5 closed at its outer end by a cover 6 in sealed relation thereto.

Referring to FIG. 2, mounted within the cylinder 4 for reciprocation axially thereof is a differential piston 8 having a stem 9 at the end adjacent the pump housing 3 and having a stem 10 at its opposite end. The valve housing 2 has an internal bore 11 coaxial with, and connected at its inner end to the adjacent end of, the cylinder 4. At the opposite end of the bore 11 and in communication therewith is a valving cavity 12 in which valve means, later to be described, are provided for controlling reciprocation of the piston 8 and regenerative circuitry. At the opposite end of the cylinder 4 from the valve housing 2, the body is provided with a bore 14, coaxial with the cylinder 4, in which the stem 9 is received.

The stem 10 fits the bore 11 with the normal operating clearance sufficient to guide the piston 8 in an axial path. The stem 10 is provided with a circumferential groove 15 in which an O-ring 16 is disposed for effecting a seal to prevent the escape of pressurized fluid from the cylinder 4 into the cavity 12.

The valve housing 2 of the body has an inlet 18 and an outlet 20.

As illustrated, the convertor utilizes a pumping assemblage driven by the differential piston 8. The pumping piston 22, in effect, is a continuation of the outer end of stem 9.

The pump housing 3 has a cavity 23 in which is disposed a pump cylinder 24 having a bore 25 generally coaxial with the cylinder 4 and with the bore 11. The pump cylinder 24 is retained within cavity 23 between a resilient seal means 26 and the mounting bracket 27.

The fluid is supplied to the pump cylinder 24 by means of inlet port 28, fluid passages (not shown), through a suitable check valve assembly (not shown) and into cylinder 24 through cavity 23 and ports 33 and 34.

Pressurized fluid is exhausted from the pump cylinder 24 via ports 33 and 34 therein by means of fluid passageways (not shown), through a suitable check valve assembly (not shown), and through the outlet port 38.

The inlet 18 of the valve housing 2 is connected by a duct 44 to the cylinder 4 at the left hand side of the piston 8. The duct 44 provides continuous communication between the inlet 18 and the cylinder 4 independently of the operating positions of the valving means. The outlet 20 of the housing 2 is connected by a duct 45 to the cavity 12 continuously.

The stem 10 is provided with a first duct 46 which is continuously connected by a lateral duct 47 with the cylinder 4 at the left or power side of the piston 8. The opposite end of the duct 46 is sealed. The duct 46 has a valving surface, spaced from the piston 8, and an annular port 48 opening through its outer circumferential surface at the valving surface. The stem 10 has a second duct 50 which extends endwise of the stem entirely through the stem and through the piston 8 and opens at its inner end into the cylinder 4 through the face or side of the piston 8 opposite from the stem 10. The duct 50 is sealed at its opposite end. Intermediate its ends, the duct 50 has an annular valving port 51 which opens through the valving surface of the stem from the port 48. The valving surface is ground and polished.

Mounted within the cavity 12 and in concentric relation to the stem 10 is a valving sleeve 55 which is polished on the interior thereof to precisely fit the valving surface of the stem 10. As shown, the sleeve 55 closes the port 48 and permits the flow from port 51 into cavity 12, from which it is vented through outlet 20. The sleeve 55 has an internal groove 56 which, when the sleeve is translated to the right, disconnects the port 51 from the cavity 12 and connects it to the port 48 thereby interconnecting the duct 46 and the duct 50 such that the cylinder 4 at the inlet side of the piston 8 communicates with the outlet side of piston 8 so that the piston is moved to the left on a return stroke from the power stroke. When this occurs, the pressurized fluid in the cylinder 4 at the inlet side of the piston 8 is transferred to the cylinder 4 at the opposite side of the piston 8.

Since the stem 9 is of smaller diameter than stem 10 with the total area of the piston 8 exposed to the pressurized fluid in the cylinder 4 being greater than at the face of the piston adjacent stem 9, the piston will be translated to the left when the fluid in the cylinder 4 is vented to the piston which contains stem 9.

When the piston 8 is fully returned and the valve sleeve 55 is moved to its extreme left hand position, the pressurized fluid admitted through the inlet 18 is directed to the left side of piston 8 and the fluid at the right side of piston 8 is vented through the duct 50, port 51, cavity 12 and duct 45 to the outlet 20.

To connect outlet ports 48 and 51 in their proper relationship the valve sleeve 55 must be moved from one operating position to the other on each stroke of the piston 8. To support the valve sleeve 55 a plurality of circumferentially spaced springs 57 are used. The circumferential spacing of the springs 57 relative to the valve sleeve 55 is such that the forces of the springs 57 are balanced to hold the sleeve floatingly in coaxial relation with the stem 10.

To move the valve sleeve 55 endwise in opposite directions past the over-center positions of the springs 57, the sleeve is provided with diametrically opposed openings 66 in which pin 67 on the stem 10 is accommodated for movement endwise with the stem relative to the valve sleeve. The opening 66 is of sufficient size relative to the pin 67 to provide a lost motion connection between the stem 10 and valve sleeve 55.

As shown, the valve sleeve 55 is at its extreme left position, and the pin 67 rests in the right hand portion of the opening 66. Accordingly, as the stem 10 moves to the right, the valve sleeve 55 is driven immediately thereby to the right, the springs 57 being compressed and rocking to the right. This continues until the valve sleeve passes the over-center position, whereupon the springs 57 drive the valve sleeve 55 to its extreme right hand position with a snap action which is permitted by the lost motion provided by the opening 66 and the pin 67. The valve sleeve 55 remains in the extreme right hand position with the pin 67 now in the left hand portion of the opening 66, or close thereto, such that as the piston 8 returns and the stem 10 moves to the left, the valve sleeve 55 is moved therewith until it again reaches the over-center position, whereupon it is moved to its extreme left position by the spring 57.

Referring to FIG. 2*a*, a suitable check valve assembly through which fluid flows into and out cylinder 24 in the prior art differential pressure hydraulic convertor is shown.

Referring to the prior art differential pressure hydraulic convertor of FIG. 3, the relationship between the check valves 31 and 37 and their respective inlet port 28 and outlet port 38 is shown. As illustrated, the check valves 31 and 37 are located approximately 90° from their respective inlet port 28 and outlet port 38. The inlet port 28 is connected to the check valve 31 by fluid passage 29 while check valve 37 is connected to outlet port 38 by fluid passage 35. Typically, four fasteners 36 are used to secure the pump housing 3 to the valve housing 2, although any suitable number may be used.

Referring to FIG. 4, an embodiment of the present invention is shown. FIG. 4 is a typical cross-sectional view of the present invention such as would be taken along line x—x of FIG. 3.

The present invention is an improved prior art differential pressure hydraulic convertor comprising a valve housing 102, cylinder 104 and pump housing 103. The present invention contemplates the use of a prior art valve housing 2, differential piston 8, and sleeve 55 as described hereinbefore, except the stem 9 of differential piston 8 is modified so as to provide a stub connecting shaft rather than a pumping piston.

In the present invention the pump housing 103 comprises a prior art pump housing 3 as described hereinbefore, except that the housing 103 has a cylindrical bore 124 having a seal cavity 127 and seal means 128 therein and having a chamfered edge 126 at one end thereof. Contained within pump housing 103 is a sleeve 125 having an outwardly flared end 129 which mates with chamfered edge 126 of pump housing 103 being retained in engagement therewith by mounting bracket 127. The sleeve 125 also is formed having an annular seal cavity 131 having a sealing means 132 therein to sealingly engage bore 125, annular recess 130 which communicates with the fluid passages (not shown) leading to the fluid check valves (not shown), first cylindrical bore 133 having a plurality of apertures 134 therein to communicate with annular recess 130 and second cylindrical bore 135 to receive piston 122 therein. Any suitable type seal means 128 and 132 may be used, although a "T" type elastomeric seal means having a fiber back-up ring is preferred.

The piston assembly comprises a piston 122 having an annular seal cavity 137 containing a sealing means 138 therein, the piston being secured by means of an interference fit to piston sleeve 123 which, in turn, is secured to stub connecting shaft 109 by a resilient pin 136. The resilient pin 136 is inserted through aperture (not shown) in sleeve 123 and engages aperture 137 in stub connecting shaft 109. To allow fluid communication to the rear of piston 122 and the face of connecting stub shaft 109, aperture 138 is provided in the piston sleeve 123. Although the piston 122 is secured to the piston sleeve 123 by means of an interference fit, any suitable fastening means may be used. Similarly, any suitable type seal means 138 may be used, although "T" type elastomeric seals having fiber back-up rings are preferred.

Referring to FIG. 5, another embodiment of the present invention is shown. FIG. 5 is a typical cross-sectional view of the present invention such as would be taken along line x—x of FIG. 3.

As before, the embodiment of the present invention as illustrated in FIG. 5 is an improved prior art differential pressure hydraulic convertor comprising a valve housing 102, cylinder 104 and pump housing 103.

However, the embodiment of the present invention as illustrated in FIG. 5 utilizes a plug 140 having an outwardly flared end 141 thereon which mates with chamfered edge 126 of pump housing 103 being retained in engagement therewith by mounting bracket 127, and having an annular seal cavity 142 having a seal means 143 therein. The seal means 143 may be of any suitable type, although a "T" type elastomeric seal means having fiber back-up rings is preferred.

The embodiment of the present invention as illustrated in FIG. 5 also utilizes a piston assembly comprising a piston 144 which reciprocates in bore 124 of pump housing 103 and is sealingly engaged by seal means 128. The piston 144 is secured by means of an interference fit to piston sleeve 145 which, in turn, is secured to connecting stub shaft 109 by a resilient pin 136. The resilient pin 136 is inserted through aperture (not shown) in sleeve 145 and engages aperture 137 in stub connecting shaft 109. To allow fluid communication to the rear of piston 144 and the face of connecting stub shaft 109, aperture 138 is provided in the piston sleeve 123. Similar to the piston assembly of FIG. 4, although the piston 144 is secured to piston sleeve 145 by means of an interference fit, any suitable fastening means may be used.

Referring to FIG. 6, yet another embodiment of the present invention is shown. The embodiment of the present invention as illustrated in FIG. 6 is an improved prior art differential pressure hydraulic convertor comprising a valve housing 102, cylinder 104 and pump housing 103.

However, in contrast to the embodiment shown in FIG. 4 and FIG. 5, the embodiment as illustrated in FIG. 6 utilizes a two-piece sleeve 150 within which piston 170 is received. The sleeve 150 comprises a first portion 151 and a second portion 152.

The first portion 151 comprises a cylindrical member having an outwardly flared end 153 which mates with chamfered edge 126 of pump housing 103 being retained in engagement therewith by mounting bracket 127, having an annular seal cavity 154 containing seal means 155 therein, having a cylindrical bore 156 which receives piston 170 therein, having a plurality of apertures 157 which allow fluid communication between cylindrical bore 156 and the exterior of the cylindrical member, having a reduced diameter portion 158 to allow fluid communication with the fluid passages (not shown) leading to the fluid check valves (not shown) in pump housing 103, and having a threaded portion 159 at one end of the cylindrical member which mates with first threaded bore 160 of the second portion 152.

The second portion 152 comprises a cylindrical member having a first threaded bore 160, having a seal cavity 161 containing a sealing means 162 therein, having a second bore 163 which receives piston 170 slidably therein, having an opening 164 and having an outer cylindrical surface 165 which mates with cylindrical bore 124 and engages seal means 128 of pump housing 103. Any suitable seal means 128, 155 and 162 may be used, although "T" type elastomeric seals having fiber back-up rings are preferred.

The piston assembly comprises a piston 170 which is secured by means of an interference fit to piston sleeve 171 which, in turn, is secured to stub connecting shaft 109 by a resilient pin 136. The resilient pin 136 is inserted through apertures (not shown) in sleeve 171 and engages aperture 137 in connecting stub shaft 109. To allow fluid communication to the rear of piston 170 and the face of connecting stub shaft 109, aperture 172 is provided in the piston sleeve 171.

Referring to FIG. 4, FIG. 5 and FIG. 6 it can be easily seen that the various embodiments of the present invention utilize the same valve housing 102, cylinder 104, pump housing 103 and connecting stub shaft 109. Similarly, it can be easily seen that to vary the ratio of the outlet fluid pressure to the inlet fluid pressure it is merely necessary to install either a different piston assembly and plug, or piston assembly and sleeve. By utilizing an easily releasable pin type connection, the piston assembly can be easily released from the connecting stub shaft 109, while utilizing a constant diameter bore in the pump housing 103 allows the use of either the end of the appropriate piston or the appropriate sleeve, either of which can be easily inserted into the pump housing 103.

It should be noted that when the piston of the present invention as illustrated in FIG. 4 is too small in diameter to accommodate seal means 138 therein, a piston assembly and sleeve arrangement should be used.

To convert a prior art differential pressure hydraulic convertor as shown in FIGS. 1, 2, 2*a* and 3 to the improved model of differential pressure hydraulic convertor as shown in FIGS. 4, 5 and 6, it is necessary to machine the prior art stem 9 and piston 22 into a stub connecting shaft 109 having an aperture therein, replace cylinder 4 with cylinder 104 which is slightly longer than original cylinder 4 to compensate for the increase in length of the piston assembly of the improved convertor, and bore out pump housing 3 to have a cylindrical bore therethrough which has a seal cavity located therein and has a chamfered edge 126 located at the end of the bore that abuts the mounting bracket of the convertor. After a suitable seal means has been installed in the seal cavity 128 machined into pump housing 3 any desired piston assembly and sleeve, if necessary, can be installed in the convertor to easily vary the ratio of outlet fluid pressure to inlet fluid pressure.

It should be noted that although a seal means 128 has been provided in the pump housing 103 to sealingly engage either the sleeves 125 or 151, or piston 144, an alternative sealing arrangement (not illustrated) can be provided by deleting the seal means 128 and cavity 127 in the pump housing 3 and installing a suitable sealing means, such as an O-ring type seal in the outer periphery of one end of the sleeves 125 or 151, or piston 144 to sealingly engage the pump housing 3.

Since the improved differential pressure hydraulic convertor can be easily converted to any desired ratio of output fluid pressure to inlet fluid pressure merely by installing different piston assemblies and sleeves, if necessary, the improved convertor is readily adaptable to a wide variety of environments and uses.

Having thus described my invention, I claim:

1. An improved hydraulic pressure convertor including a body having an inlet and an outlet, a motor assemblage carried by the body and including a power cylinder and a differential driving piston reciprocable therein, a pumping assemblage, means connecting the differential driving piston to the pumping assemblage, a first conduit in continuous communication at one end with the inlet and with the power cylinder at the side of the differential driving piston to which fluid pressure is to be applied for driving the differential driving piston on its power stroke, a second conduit continuously in communication at one end with the power cylinder at the opposite side of the differential driving piston, each of said conduits having a valving port spaced from its said one end, a valve operative in a first operating position in which it blocks the valving port of the first conduit and concurrently connects the valving port of the second conduit with the outlet and operative in a second operating position in which it effects communication of said ports with each other and concurrently stops communication of the second port with the outlet, lost motion connecting means connecting the valve to the differential piston so as to effect actuation of the valve toward said first operating position past a predetermined center position as the differential piston is moved a predetermined distance on its power stroke and to effect actuation of the valve toward said second operating position past said center position as the differential piston is moved a predetermined distance on its return stroke, and over-center spring means connected to the valve and operative when the valve is actuated past said center position in directions toward said first and second operating positions, respectively, to drive the valve with a snap action to the one of the said first and second operating positions toward which the valve was being actuated as it passed said center position, wherein the improvement comprises:

said hydraulic pressure convertor having a variable ratio of the pressure of the outlet fluid from said pumping assemblage to the pressure of the inlet fluid to said motor assemblage by varying the size of a detachable piston assembly attached to said differential driving piston in said power cylinder and varying the size of a pumping assemblage means operatively associated with said detachable piston assembly, wherein said differential driving piston comprises a driving piston having stem means operably associated with said motor assemblage, having differential piston connected to the stem portion, thereby separating said motor assemblage and said pumping assemblage, and having stub connecting shaft means connected to said differential driving piston and extending into said power cylinder, the stub connecting shaft means having a transverse bore therethrough;

said pumping assemblage having a housing being formed having a substantially cylindrical bore therethrough and having a seal means located in an annular cavity therein; and said detachable piston assembly comprising:

piston means;

sleeve means secured to the piston means, the sleeve means having a bore therein receiving the stub connecting shaft means of said differential driving piston therein and having a transverse bore therein which aligns with the transverse bore in the stub connecting shaft means of said differential driving piston when the sleeve means is assembled thereto; and resilient pin means securing the sleeve means to the stub connecting shaft means of said differential driving piston by engaging the transverse bore in the sleeve means and the transverse bore in the stub connecting shaft means.

2. The improved hydraulic pressure convertor of claim 1 wherein said detachable piston assembly further comprises:

seal means installed in the outer periphery of the piston means; and wherein said pumping assemblage means comprises:

cylindrical sleeve means retained within the substantially cylindrical bore of the housing of said pumping assemblage, the cylindrical sleeve means having seal means installed in the outer surface thereof, having another portion of the outer surface thereof sealingly engaging the seal means in the substantially cylindrical bore in the housing of said pumping assemblage and having a bore therein receiving the piston of said detachable piston assembly in sliding sealing engagement therewith.

3. The improved hydraulic pressure convertor of claim 1 further comprising:

plug means retained in one end of the substantially cylindrical bore in the housing of said pumping assemblage, the plug means having seal means located in the outer periphery thereof sealingly engaging the substantially cylindrical bore in the housing of said pumping assemblage.

4. The improved hydraulic pressure convertor of claim 1 wherein said pumping assemblage means comprises:

cylindrical sleeve means retained within the substantially cylindrical bore of the housing of said pumping assemblage, the cylindrical sleeve means having seal means installed in the outer surface thereof, having another portion of the outer surface thereof sealingly engaging the seal means in the substantially cylindrical bore in the housing of said pumping assemblage, having a bore therein receiving the piston of said detachable piston assembly in sliding engagement therewith and having seal means installed in the bore therein for sealingly engaging the piston of said detachable piston assembly.

* * * * *